US012369710B2

(12) United States Patent
Callahan

(10) Patent No.: US 12,369,710 B2
(45) Date of Patent: Jul. 29, 2025

(54) STORAGE SYSTEM

(71) Applicant: Patrick J. Callahan, Batavia, IL (US)

(72) Inventor: Patrick J. Callahan, Batavia, IL (US)

( * ) Notice: Subject to any disclaimer, the term of this patent is extended or adjusted under 35 U.S.C. 154(b) by 84 days.

(21) Appl. No.: 17/850,768

(22) Filed: Jun. 27, 2022

(65) Prior Publication Data

US 2022/0408914 A1 Dec. 29, 2022

Related U.S. Application Data

(60) Provisional application No. 63/215,246, filed on Jun. 25, 2021.

(51) Int. Cl.
*A47B 45/00* (2006.01)
*A47B 46/00* (2006.01)
(Continued)

(52) U.S. Cl.
CPC ..... *A47B 45/00* (2013.01); *A47B 46/00* (2013.01); *A47B 87/005* (2013.01); *A47B 61/02* (2013.01)

(58) Field of Classification Search
CPC ..... A47B 45/00; A47B 87/005; A47B 61/02; A47B 61/00; A47B 88/41; A47B 88/42; A47B 53/00; A47B 2210/0056; A47B 46/00; A47B 2210/0062; A47B 2210/0037; A47B 81/00; A47B 88/48; A47B 88/403; A47B 96/04; E05Y 2900/212; E05Y 2900/20; E05Y 2201/684; E05Y 2900/14; E05Y 2900/142; E05D 15/58; E05D 15/264; E05D 15/0621; E05D 3/022; E04B 2/827; A47F 5/0093; A47F 3/063; A47F 5/0006; A47F 5/0087; E06B 3/5045; E06B 3/482; E06B 3/385; E06B 3/509; E06B 3/5072
See application file for complete search history.

(56) References Cited

U.S. PATENT DOCUMENTS 2,254,431 A * 9/1941 Samuel ..... A47B 88/42
2,936,206 A * 5/1960 Wilmer ..... E05D 15/58 49/257

(Continued)

FOREIGN PATENT DOCUMENTS

DE 4308196 A1 * 10/1993 ..... E05D 15/264
DE 202005000990 U1 * 6/2006 ..... E05D 15/0621
DE 202018103969 U1 * 9/2018

OTHER PUBLICATIONS

DE202018103969 translation (Year: 2018).*

*Primary Examiner* — Hiwot E Tefera
(74) *Attorney, Agent, or Firm* — K&L Gates LLP

(57) ABSTRACT

A storage system includes a framing assembly, a plurality of storage units, and a sliding wall assembly. The framing assembly includes a plurality of side panels and a plurality of rear panels. Each storage unit includes a top surface and a base surface, each of the top surface and the base surface secured to and spanning a pair of side panels and the associated rear panel. The sliding wall assembly includes a sliding wall and upper and lower track systems. The sliding wall moves laterally parallel to the plurality of side panels. Each track system includes a panel track member and a wall track member, wherein the panel track member is secured to a side panel and the wall track member is secured to the upper or lower surface of the sliding wall.

17 Claims, 14 Drawing Sheets

(51) Int. Cl.
*A47B 87/00* (2006.01)
*A47B 61/02* (2006.01)

(56) References Cited

U.S. PATENT DOCUMENTS 3,135,570 A * 6/1964 Erismann ..... E06B 3/385 312/317.2
3,749,465 A * 7/1973 Newcomer ..... F16B 12/22 312/263
4,427,244 A * 1/1984 Castagna ..... A47B 85/08 312/246
4,436,352 A * 3/1984 Okada ..... A47L 19/04 312/238
4,502,742 A * 3/1985 Neff ..... A47B 53/00 312/324
4,688,687 A * 8/1987 Pryor ..... A47B 61/00 211/37
5,072,838 A * 12/1991 Price, Jr. ..... A47B 81/068
5,265,739 A * 11/1993 Price, Jr. ..... A47F 3/06
5,395,165 A * 3/1995 Woerner ..... E05D 15/58 211/27
5,417,486 A * 5/1995 Manlove ..... A47B 53/02 188/4 R
5,468,063 A * 11/1995 Simonek ..... A47B 88/42 312/287
5,657,743 A * 8/1997 Schwarzbacker ..... F24C 15/023 49/176
6,076,906 A * 6/2000 Royal ..... H05K 7/1421 312/273
6,318,824 B1 * 11/2001 LaGrotta ..... E06B 3/5045 312/322
6,990,771 B2 * 1/2006 Pfaff ..... E05F 15/643 49/94
2001/0028208 A1 * 10/2001 Reilly ..... A47B 88/42 312/286
2002/0140328 A1 * 10/2002 Dressendorfer ..... A47B 88/42 312/334.23
2004/0100173 A1 * 5/2004 Jakob-Bamberg ..... A47B 88/42 312/330.1
2007/0278914 A1 * 12/2007 Verfaillie ..... A47B 88/42 312/226
2010/0132895 A1 * 6/2010 Logue ..... A47B 46/005 160/405
2010/0201230 A1 * 8/2010 Schweitzer, III ..... H02B 3/00 312/294
2012/0152767 A1 * 6/2012 Harry ..... A47B 81/005 206/317
2015/0008811 A1 * 1/2015 Ishii ..... E06B 3/5045 312/322
2015/0300075 A1 * 10/2015 Lyons ..... E05D 15/58 49/177
2016/0007744 A1 * 1/2016 Fasino ..... A47F 5/0087 211/85.5
2017/0164765 A1 * 6/2017 Young ..... A47B 88/42
2017/0295928 A1 * 10/2017 Allen ..... A47B 61/04
2019/0063871 A1 * 2/2019 Cain ..... F41C 33/06
2019/0178504 A1 * 6/2019 Clements ..... A47B 77/08
2019/0301218 A1 * 10/2019 Rupp ..... E05D 15/58
2019/0365094 A1 * 12/2019 Allen ..... F24F 7/00
2020/0040632 A1 * 2/2020 Rupp ..... A47B 77/08
2020/0397139 A1 * 12/2020 McNichols ..... B62B 5/06

* cited by examiner

STORAGE SYSTEM

CROSS-REFERENCE

This application claims the benefit of priority to U.S. Provisional Application No. 63/215,246, filed Jun. 25, 2021, the entire disclosure of which is hereby incorporated by reference.

BACKGROUND

The present subject matter relates generally to storage systems. More specifically, the present subject matter provides an independent and repositionable, high-density storage system adapted for use in a classroom setting.

Conventional storage units (e.g., casework, millwork solutions) provide storage for a variety of spaces, such as classrooms. However, such systems typically occupy valuable floor space of a classroom, thereby limiting space for students to gather and work. In addition, such conventional storage systems such as bookshelves and drawer units can create clutter and safety hazards for students.

Moreover, conventional systems often require elaborate installations that are both time consuming and expensive. For example, many conventional classrooms include uneven floors and ceilings, which interfere with the installation of sliding whiteboard classroom doors.

Further, conventional storage units are often singularly focused on specific storage units such as books, bins, etc. As a result, a variety of storage systems must be purchased in order to store the variety of items in a classroom. Such systems are not cost effective and often are not compatible with one another.

Accordingly, there is a need for an independent and repositionable, high-density storage system adapted for use in a classroom setting, as described herein.

BRIEF SUMMARY

The present disclosure provides a storage system. Various examples of the systems are provided herein.

The present system provides a moveable, compact (i.e., high-density) storage unit system that can elevate storage units (e.g., bookshelves, cubbies, carts, bins, etc.) that would otherwise occupy valuable floor space in a room. The present system provides for efficient and accessible storage of classroom materials to minimize retrieval and setup time, which increases contact time between the teacher and student. In addition, because the system is easily moveable, it can be used as a room divider, for example, to provide a fast, safe, calming zone to provide inclusion of students with disabilities without having to remove the student from the classroom.

In one embodiment, the storage system of the present application includes a framing assembly, a plurality of storage units, and a sliding wall assembly. The framing assembly includes a plurality of side panels and a plurality of rear panels, each side panel including a front vertical edge and a rear vertical edge. A rear panel associated with each pair of side panels spans the rear vertical edges thereof. Each storage unit includes a top surface and a base surface, each of the top surface and the base surface secured to and spanning a pair of side panels and the associated rear panel. The sliding wall assembly includes a sliding wall including an upper surface and a lower surface, wherein the sliding wall moves laterally parallel to the plurality of side panels. An upper track system includes an upper panel track member and an upper wall track member, wherein the upper panel track member is secured to a side panel the upper wall track member is secured to the upper surface of the sliding wall. A lower track system includes a lower panel track member and a lower wall track member, wherein the lower panel track member is secured to the side panel and the lower wall track member is secured to the lower surface of the sliding wall. Each of the upper and lower wall track members engage the upper and lower panel track members, respectively.

In some embodiments, the storage system further includes a sliding door assembly including a door track member and one or more doors. The door track member is secured to one or more base surfaces of the plurality of storage units along a front edge. The door track member includes a front track and a rear track, each door including a door roller assembly on an upper door edge thereof, wherein the roller assembly includes a roller that engages the front track or the rear track of the door track member.

An advantage of the present system is that it consolidates multiple classroom storage devices into one single system. Moreover, the present system can be used to at least double the cubic storage of standard classrooms.

A further advantage of the present system is that it provides customized organization for various grade levels while improving classroom efficiency for teacher to student interaction.

Another advantage of the present system is providing high-density storage without the need for the system to attach to existing building structural components.

Another advantage of the present system is overcoming conventional installation issues associated with uneven flooring.

Additional objects, advantages, and novel features of the examples will be set forth in part in the description, which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

Figure 1:
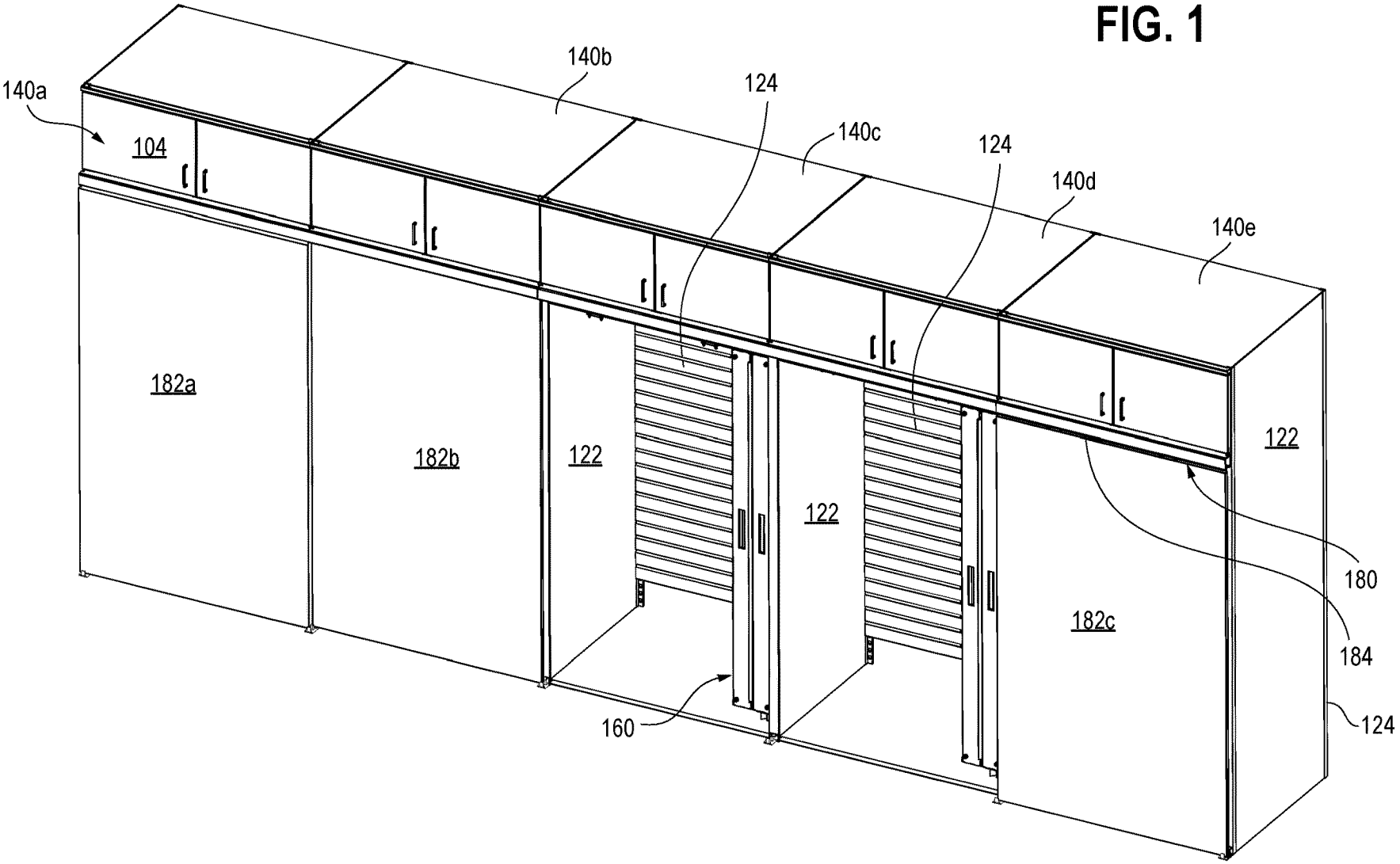
FIG. 1 is a perspective view of an example of the storage system of the present application.

The exemplifications set out herein illustrate certain embodiments, in one or more forms, and such exemplifications are not to be construed as limiting the scope of the appended claims in any manner.

DETAILED DESCRIPTION

Example storage systems according to the present disclosure are shown in FIGS. 1-14. FIGS. 1-8B illustrate a first embodiment of the storage system 100 of the present application and FIGS. 9-13 illustrate a second embodiment of the storage system 200 of the present application. Generally, each storage system 100, 200 includes a framing assembly 120, 220 or other structure that supports one or more storage units 140, 240, one or more sliding door assemblies 160, 260, and a sliding door assembly 180, 280.

Each storage system 100, 200 utilizes different components to provide the functionality of each subsystem as described in greater detail below. Further, although shown in a generally rectangular form, the storage system can be constructed in any suitable shape and size as desired.

Framing Assembly

In the first embodiment illustrated in FIGS. 1-8B, the framing assembly 120 includes a plurality of side panels 122 and a plurality of rear panels 124 interconnected through brackets and connectors to structurally support the overhead storage units 140, the sliding wall assemblies 160, and the sliding door assembly 180. For each overhead storage unit 140, the storage system 100 includes a pair of opposing side panels 122, with one side panel 122 able to support two side-by-side overhead storage units 140. A rear panel 124 spans each pair of side panels 122.

Each side panel 122 includes a front vertical edge 122*a* and a rear vertical edge 122*b*. A rear panel 124 is associated with each pair of side panels 122 spans the rear vertical edges 122*b* thereof. The rear panel 124 and pair of side panels 122 form a "C" shape. The space defined by each pair of side panels 122 and the associated rear panel 124 is a storage compartment 126.

The rear panels 124 are aligned along a rear side 100*a* of the storage system 100. The sliding door assembly 180 is provided along a front side 100*b* of the storage system 100. Each side panel 122 span the rear side 100*a* and the front side 100*b* of the storage system 100.

In the second embodiment shown in FIGS. 10-13, the framing assembly 220 includes a plurality of single scaffolds 222 and a plurality of double scaffolds 224. The single scaffolds 222 are aligned along a rear side 200*a* of the storage system 200, and the double scaffolds 224 are aligned along a front side 200*b* of the storage system 200. The single scaffolds 222 and double scaffolds 224 are configured to support the storage units 240 as described in greater detail below. The storage space below each storage unit 240 and between each adjacent pair of single scaffolds 222 and pair of double scaffolds 224 is each storage compartment 226.

Figure 9:
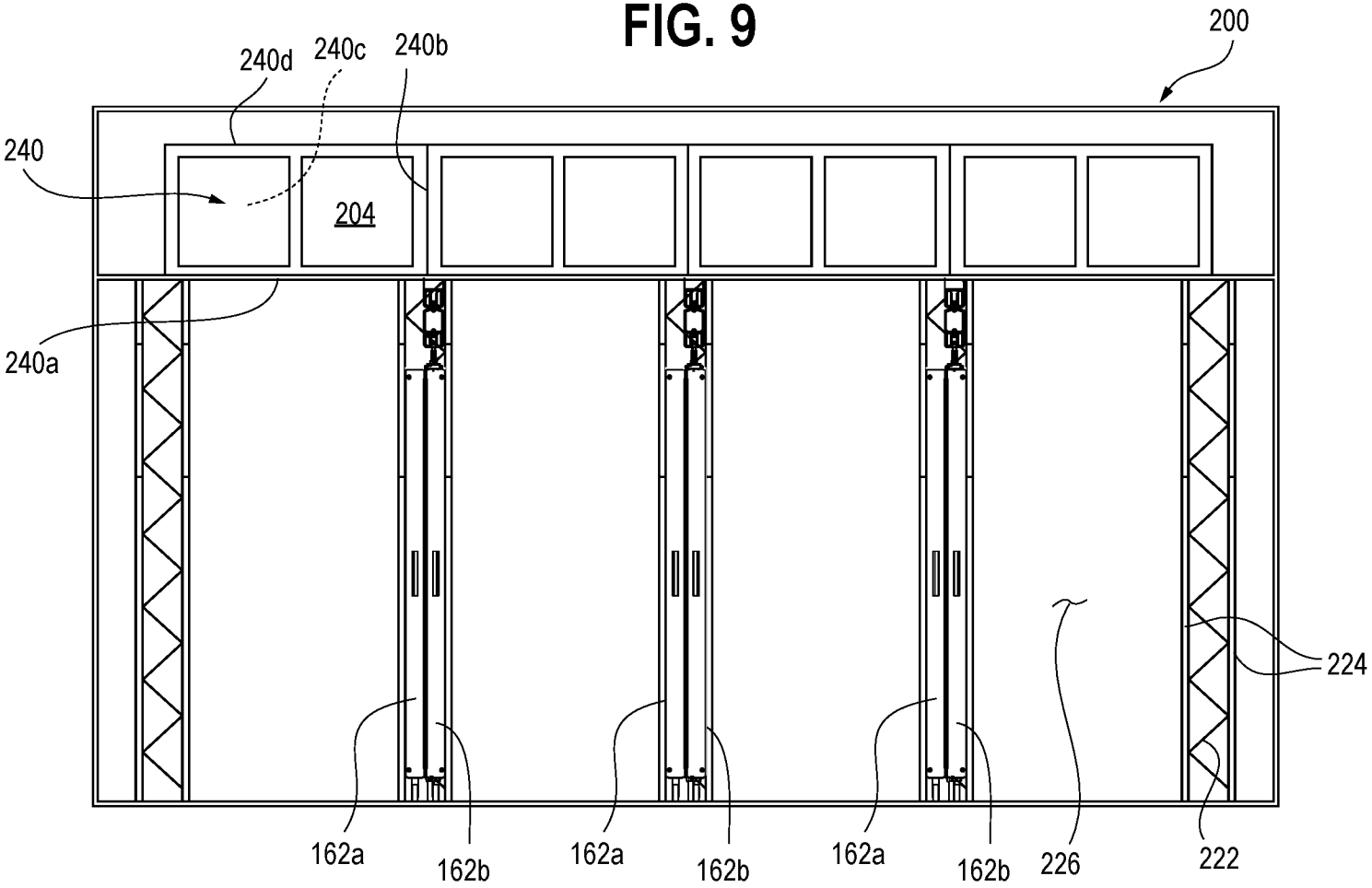
FIG. 9 is a front elevational view of an alternative embodiment of the storage system of the present application.
Figure 10:
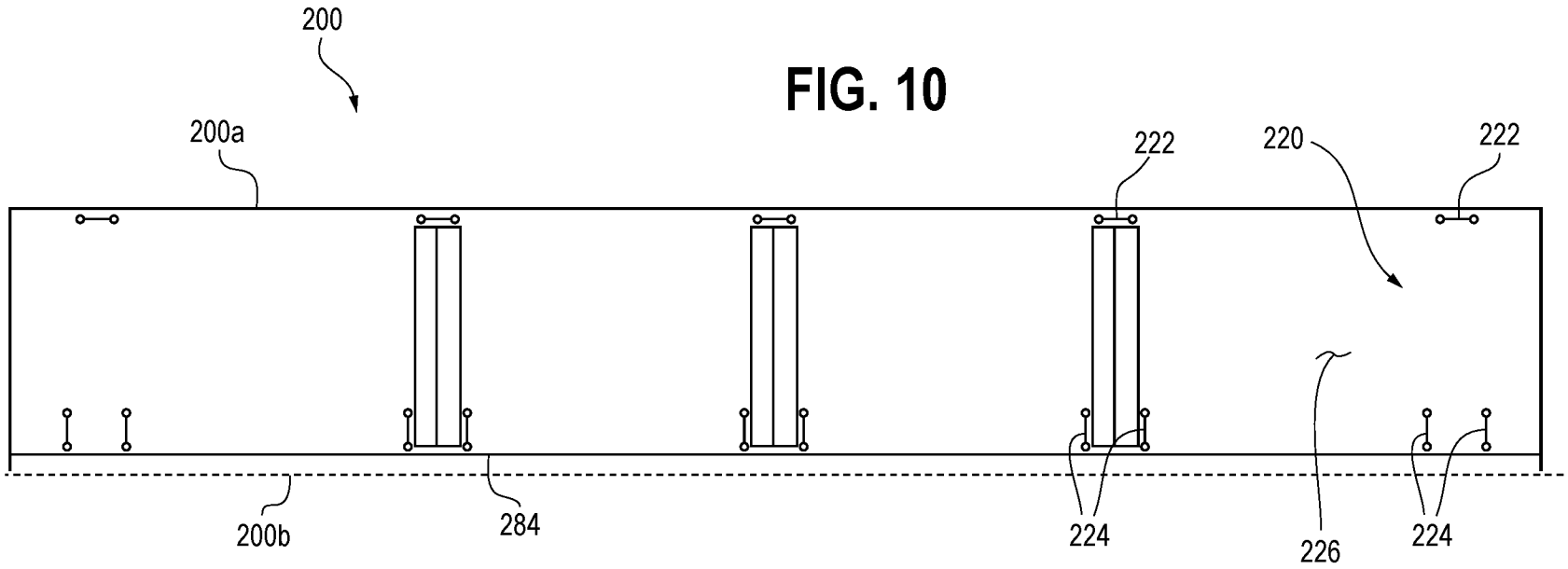
FIG. 10 is a cross-sectional view of the storage system of FIG. 9 generally taken along lines 10-10 of FIG. 9.

Referring to FIGS. 9 and 10, each single scaffold 222 comprises a truss 222*a* connected to a single scaffold top plate 222*b*, and each double scaffold comprises a first truss 224*a* and a second truss 224*b* parallel to one another and connected to a double scaffold top plate 224*c*. Each truss 222*a*, 224*a*, 224*b* includes a structure of beams along a two-dimensional plane. The truss 222*a* of each single scaffold 222 is oriented so that the two-dimensional plane is parallel to the front and rear sides 200*b*, 200*a* of the storage system 200. The trusses 224*a*, 224*b* of each double scaffold 224 are oriented so that the two-dimensional planes are perpendicular to the front and rear sides 200*b*, 200*a* of the storage system 200.

Figure 11:
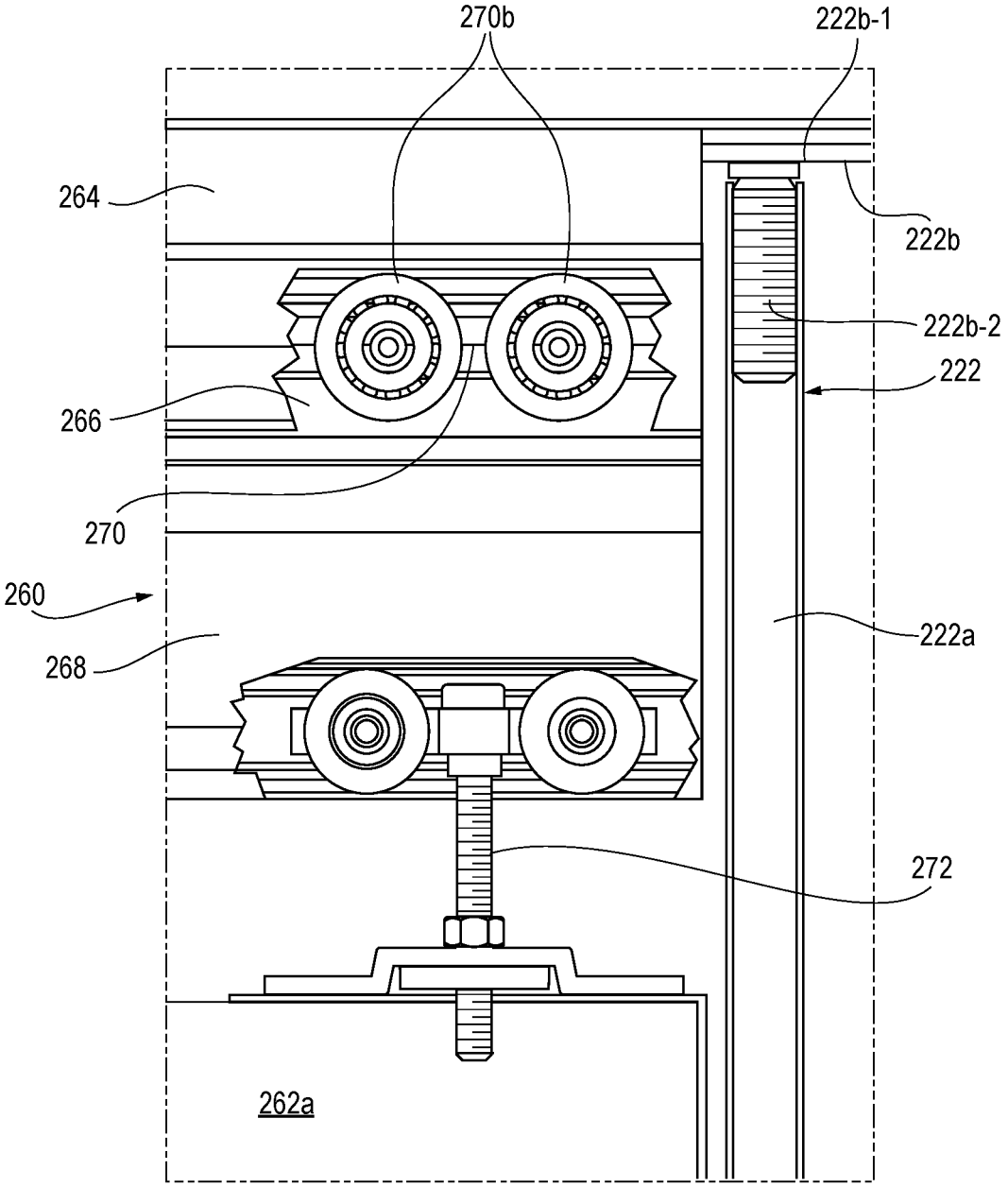
FIGS. 11 and 12 are side and front elevational views, respectively, of a roller assembly of the sliding wall assembly of the storage system of FIG. 9.
Figure 12:
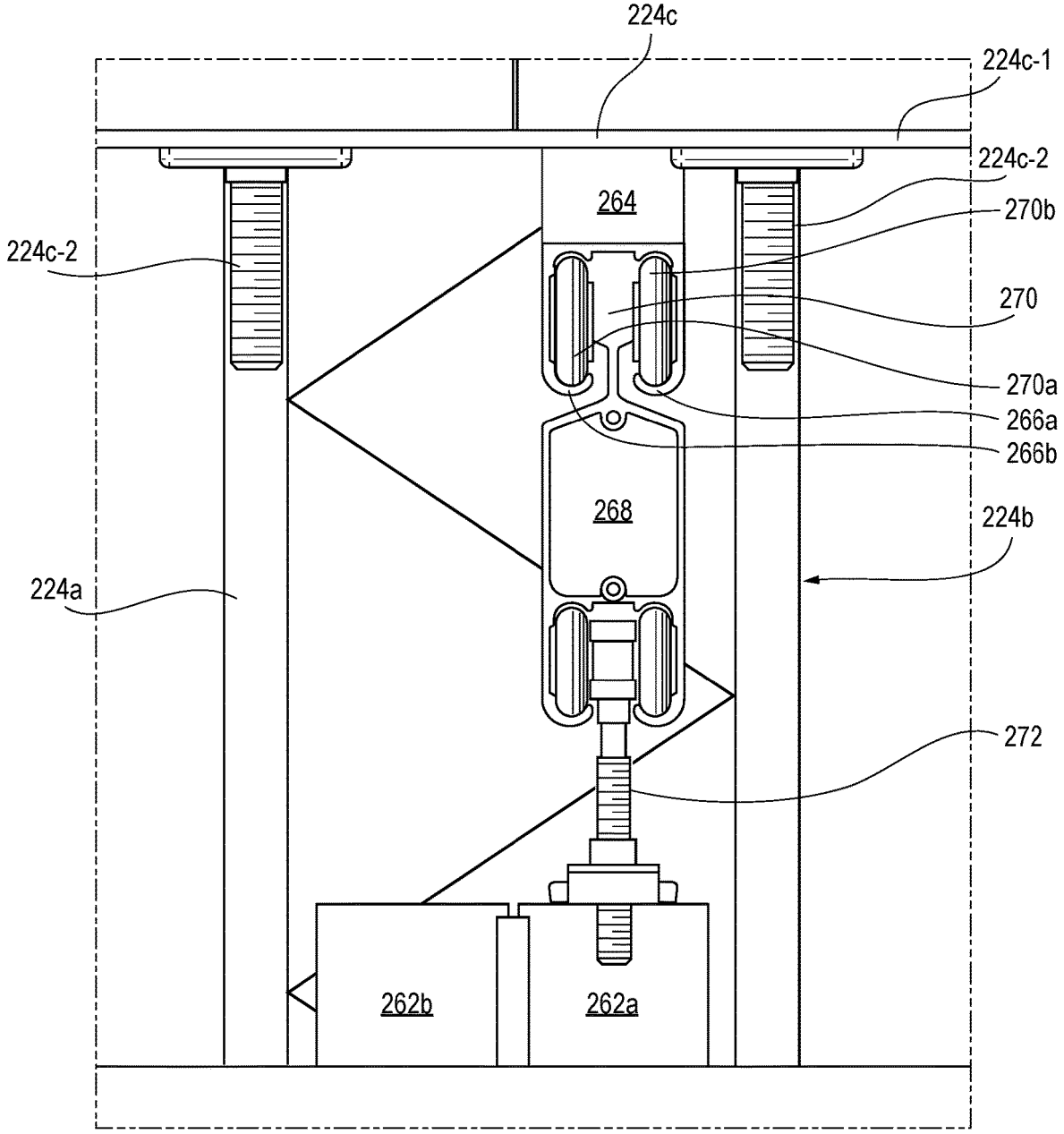
Figure 13:
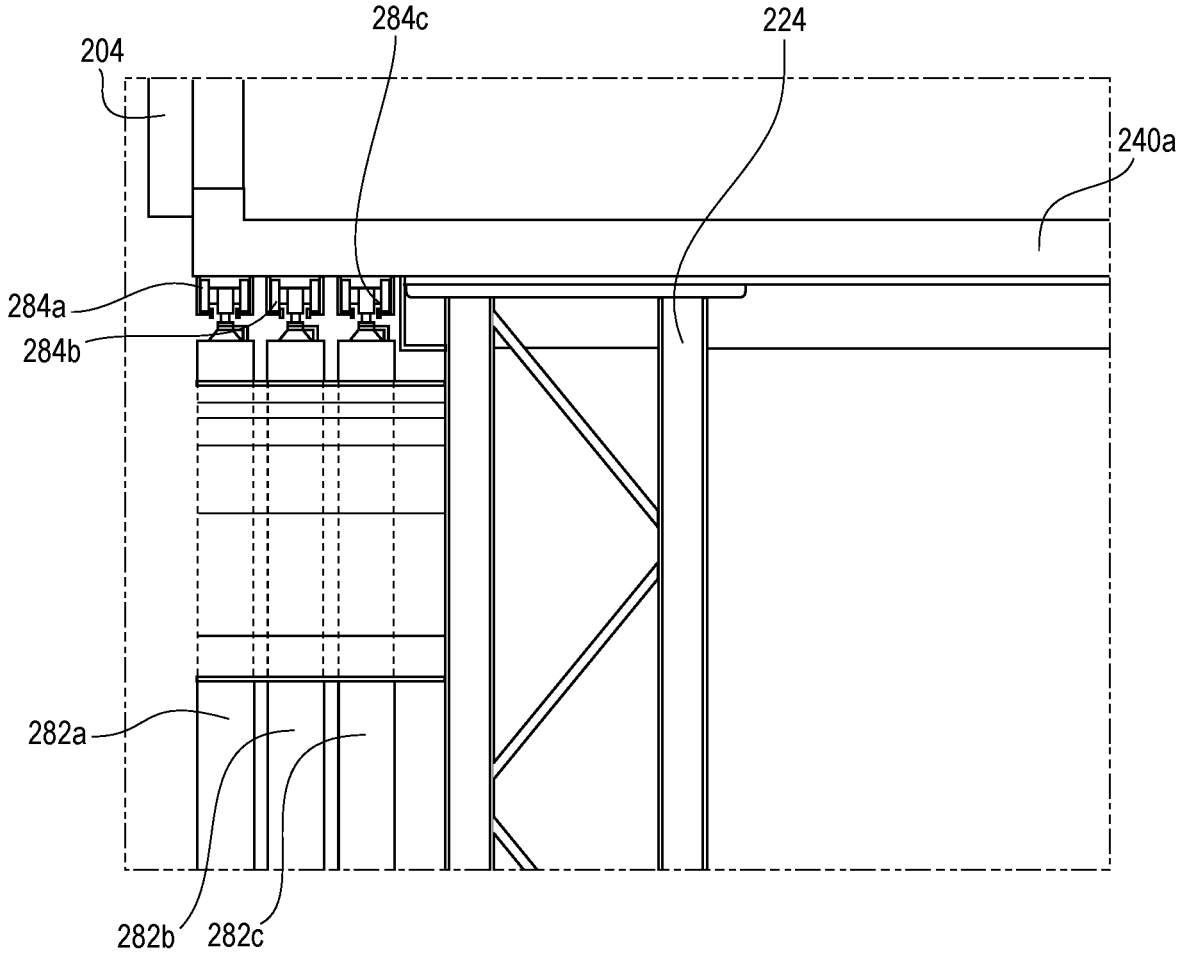
FIG. 13 is a side elevational view of sliding door tracks of a sliding door assembly of the storage system in FIG. 9.

Shown in FIGS. 11-13, each top plate 222*b*, 224*c* includes a planar member 222*b*-1, 224*c*-1 having tubular protrusions 222*b*-2, 224*c*-2 extending from an underside surface thereof for engaging with the trusses 222*a*, 224*a*, 224*b*. The single scaffold top plate 222*b* includes a two protrusions 222*b*-2 extending downwardly from the planar member 222*c*-1, which are received by vertical tubular members of the respective truss 222*a*. The double scaffold top plate 224*c* includes four protrusions 224*c*-2 extending downwardly from the planar member 224*c*-1. One pair of the four protrusions 224*c*-2 are received by vertical tubular members of first truss 224*a*, and the other pair of the four protrusions 224*c*-2 are received by vertical tubular members of second truss 224*b*. In some embodiments, the positioning of the protrusions 224*c*-2 on the planar member 224*c*-1 can be customized to fit with a specific truss design.

In the example shown in FIG. 10, the single scaffold top plate 222*b* is a first size and the double scaffold top plate 224*c* is a second size larger than the first size. In various examples (not shown), the first size and the second size can be the same. The size and shape of the scaffolds and the top plates can vary by design. The figures are simply illustrative of one example.

In some embodiments, the framing assembly 220 may include a plurality of main support members or beams, each main support member spanning each pair of single and double scaffolds 222, 224. The connections between the main support members and the respective top plates can be by fasteners, welds, and/or the like. In various examples, the main support members can be connected to the storage units.

In both embodiments of the storage system 100, 200, connectors, brackets, and other components may be used as needed and as is known in the art to interconnect the components of the framing assemblies 120, 220.

Storage Units

The storage systems 100, 200 include storage units 140, 240 along the top of the frame assembly 120, 220 to provide storage of items. In the illustrated embodiments, each storage unit 140, 240 includes a closable pair of hinged doors 104, 204 providing access to a cavity 106, 206 of the storage unit 140, 240, although one or more storage units 140, 240 may include sliding doors, a single hinged door, no doors, or other closure mechanisms as desired.

In the first embodiment of FIGS. 1-8B, each storage unit 140 includes a top surface 142 and a base surface 144 positioned in parallel, with each of the top surface 142 and the base surface 144 spanning a pair of side panels 122 and the associated rear panel 124. The hinged doors 104 provide access to the cavity 106 defined by the top and base surfaces 142, 144.

Figure 4:
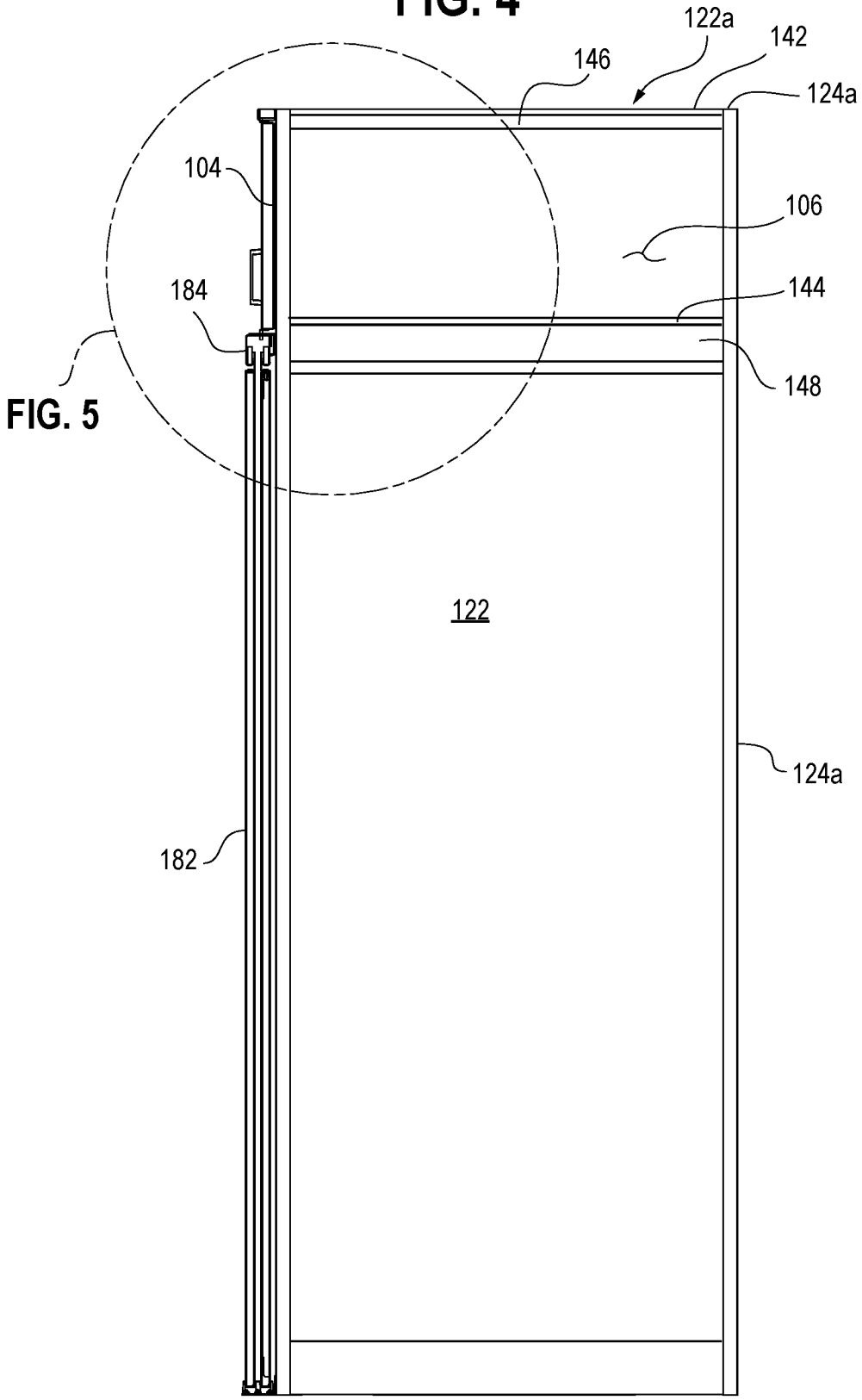
FIG. 4 is a cross-sectional view of the storage system of FIG. 1 generally taken along lines 4-4 in FIG. 2.
Figure 5:
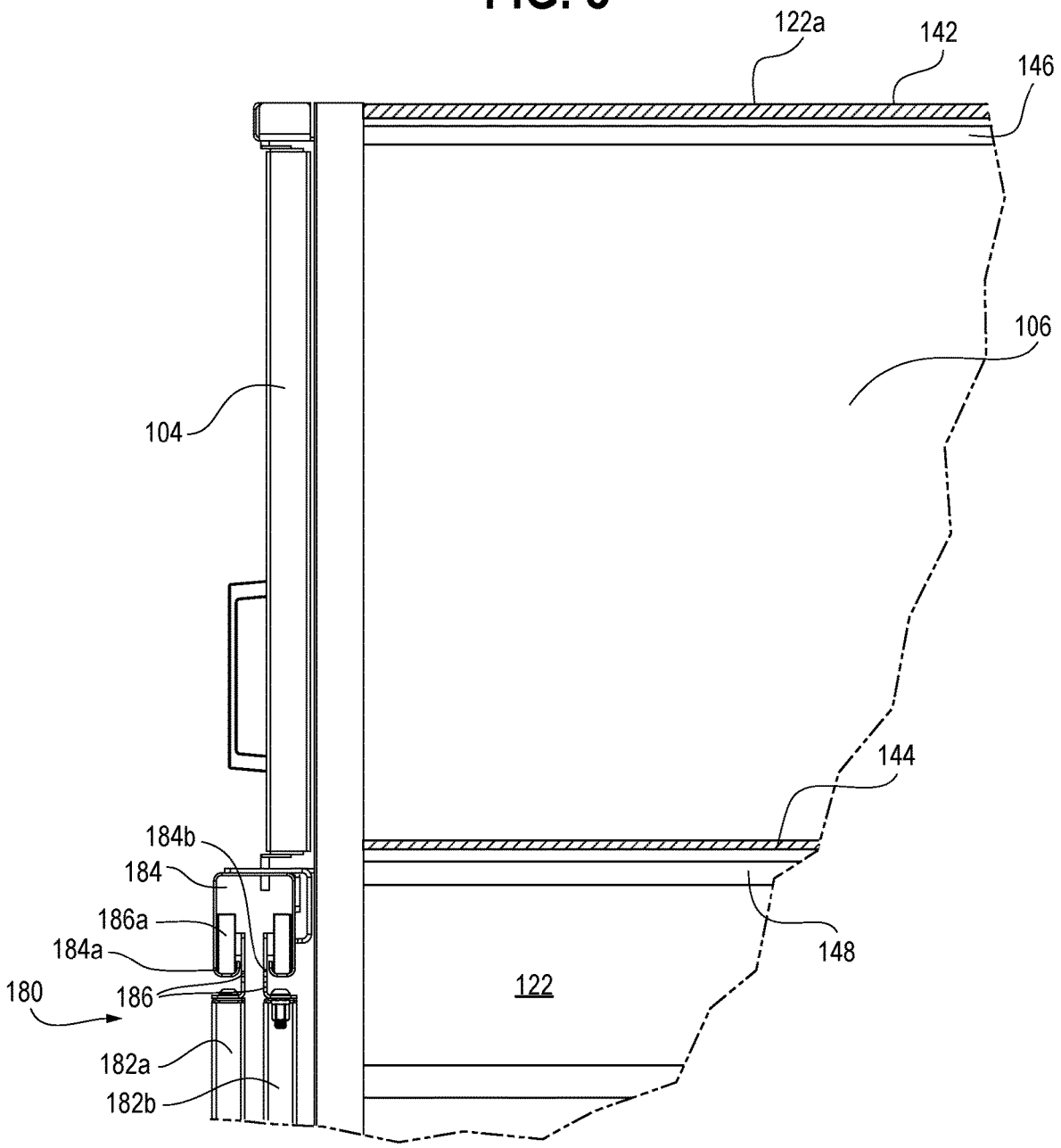
FIG. 5 is an enlarged side elevational view of a portion of the storage system indicated in FIG. 4.
Figure 6:
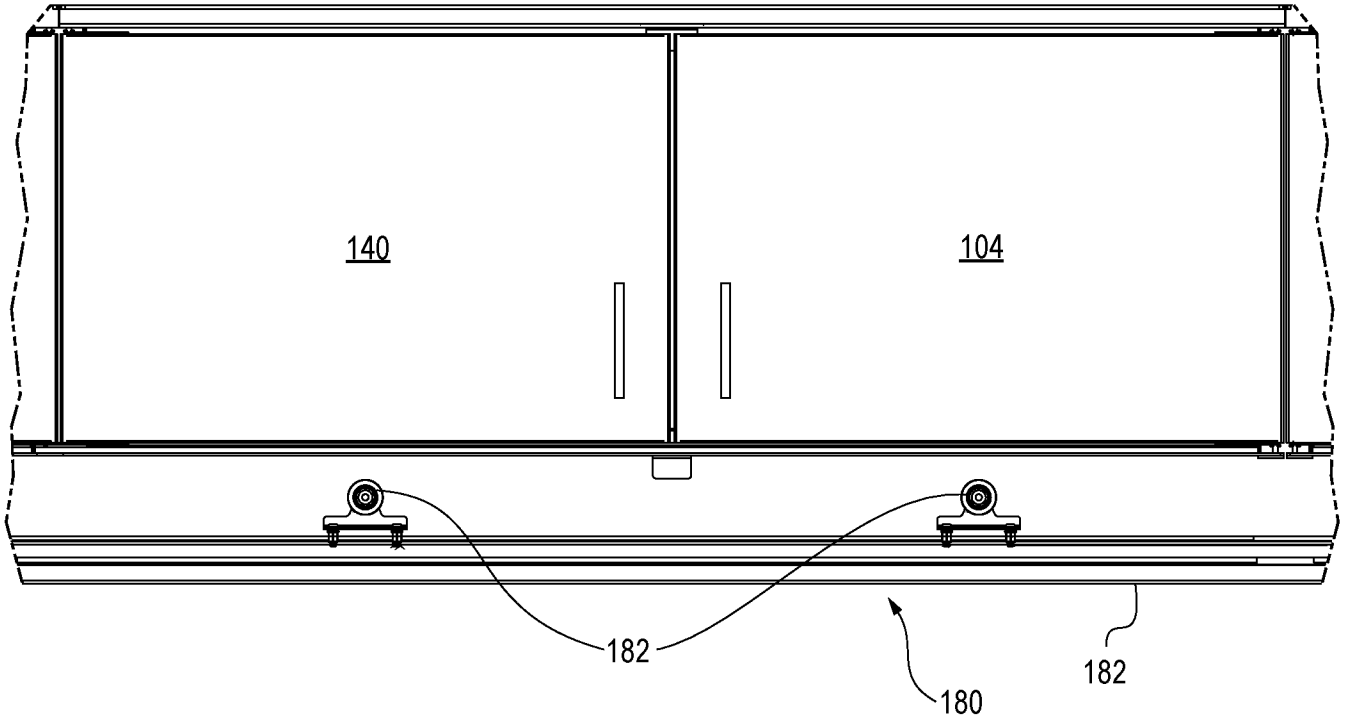
FIG. 6 is an enlarged front elevational view of another portion of the storage system indicated in FIG. 2.
Figure 7:
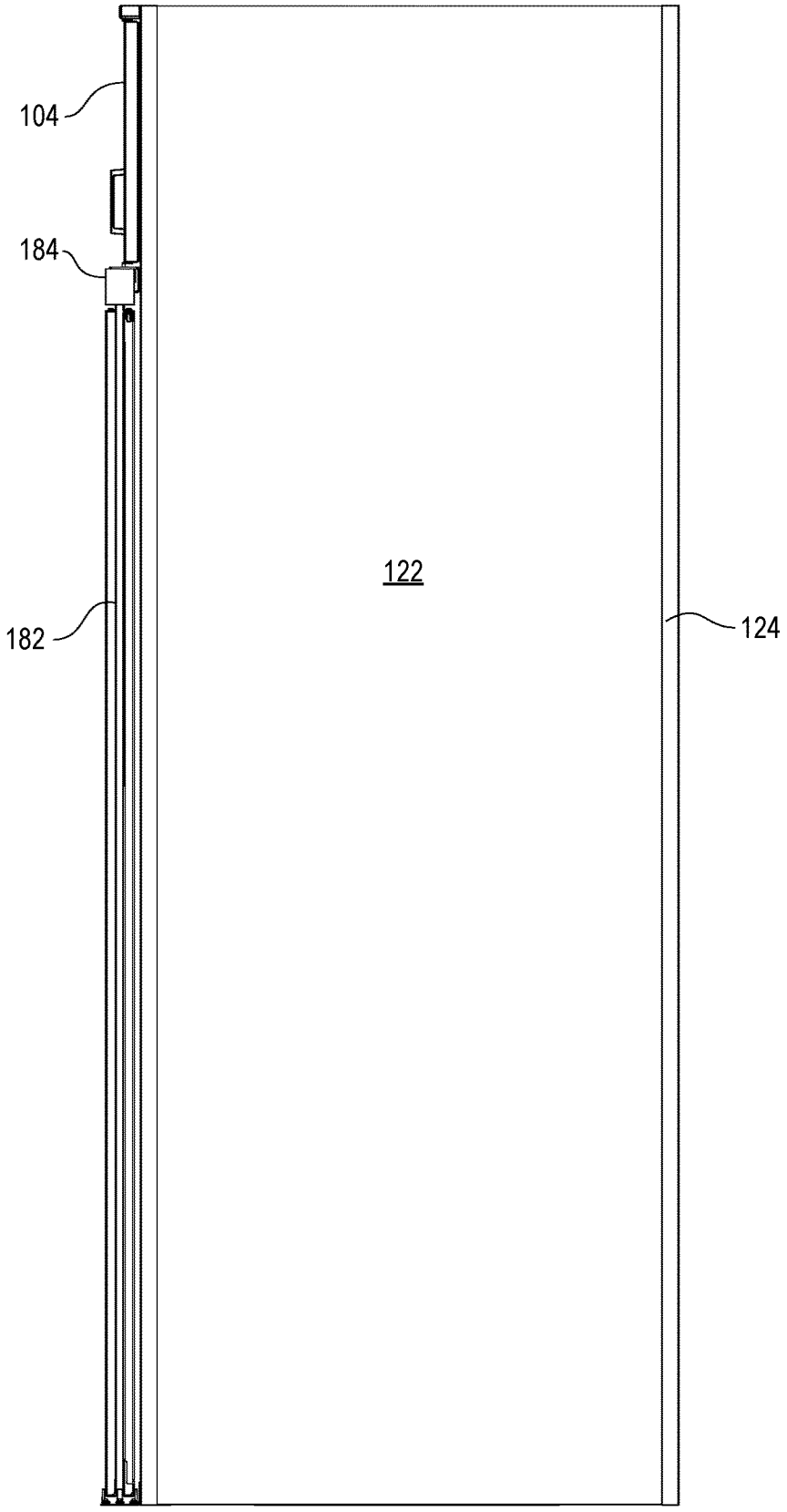
FIG. 7 is a side elevational view of the storage system of FIG. 1.

In the embodiment illustrated in FIGS. 4 and 5, the top surface 142 of the storage unit 140 is supported by a plurality of top surface shelf supports 146 that are attached to inner surfaces of the parallel side panels 122 and rear panel 124. The top surface shelf supports 146 are positioned near upper edges 122*a*, 124*a* of the side panels 122 and rear panel 124 so that the top surface 142 spans the upper edges 122*a*, 124*a* thereof.

The base surface 144 of the storage unit 140 is similarly supported by a plurality of base surface shelf supports 148 that are attached to inner surfaces of the parallel side panels 122 and rear panel 124. The base surface shelf supports 148 are parallel to and spaced from the top surface shelf supports 146 to define the cavity 106 therein.

In some embodiments, additional support members span one or more of the side and rear panels to provide additional support for the bottom surface and/or the top surface of the storage container. Additionally, the top surface shelf supports 146 and the base surface shelf supports 148 may include additional bracket portions, elongated portions, shouldered edges, and the like to provide additional surfaces onto which other elements may be mounted. For example, the hinged doors 104, 204 include hinging components secured to the top surface shelf supports 146 and/or the top surface 142 as shown in FIG. 5.

In the second embodiment illustrated in FIGS. 9-13, the storage units 240 are positioned above the framing assembly 220. Each storage unit 240 comprises a base surface 240*a*, opposing side surfaces 240*b*, a rear surface 240*c*, and a top surface 240*d*. The surfaces 240*a*-240*d* of each storage unit 240 form a cavity 206 configured to receive items for storage. The surfaces of the storage unit 240*a*-240*d* are secured together through brackets or other suitable connection means.

As shown in FIG. 9, each side surface 240*b* of the storage units 240 is centered on an aligned single scaffold 222 and double scaffold 224.

In some examples, the storage units may include an aluminum, round swivel on the base of the storage unit to enable accessibility of all items in the storage unit.

Sliding Wall Assembly

Figure 8A:
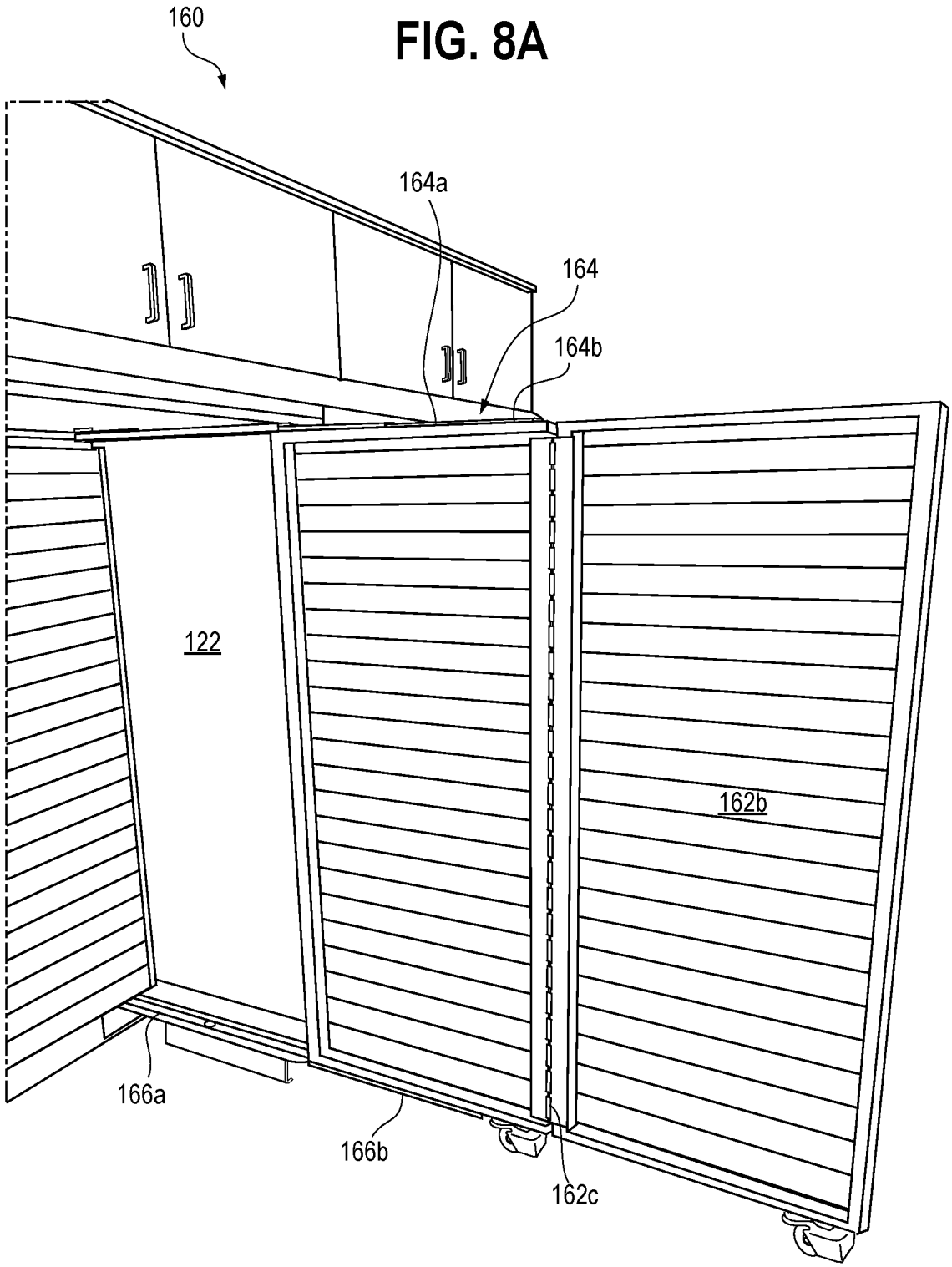
FIGS. 8A and 8B are perspective views of a sliding wall assembly of the storage system of FIG. 1 in an extended position from the right and left views, respectively.
Figure 8B:
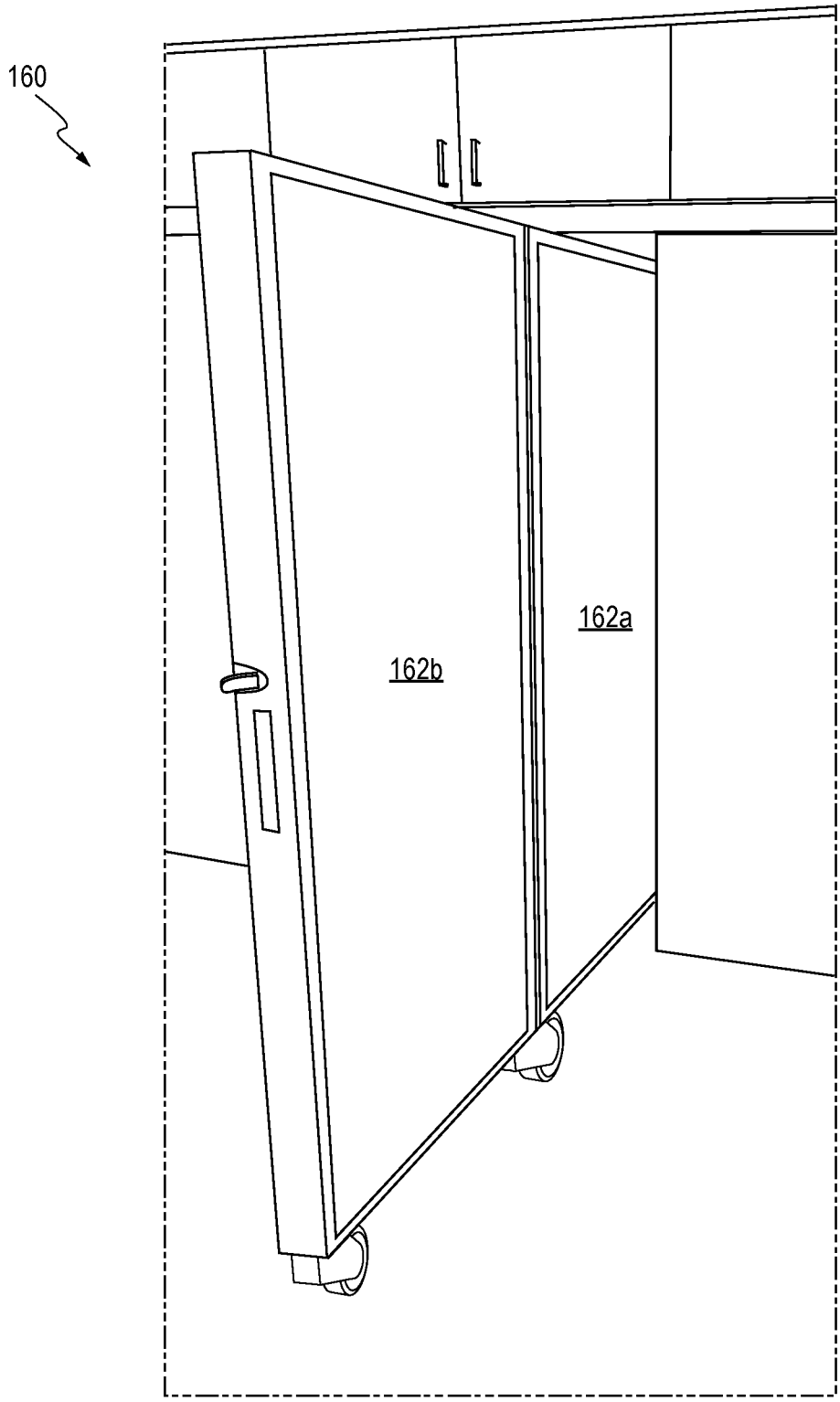

The storage system 100, 200 includes one or more sliding wall assemblies 160, 260 enabling a slidable wall 162, 262 to move laterally between a retracted position and an extended position as shown, for example, in FIGS. 1, 8A, and 8B. In the illustrated embodiments, each sliding wall 162, 262 includes a first vertical panel 162*a*, 262*a* and a second vertical panel 162*b*, 262*b* that are hingedly connected by one or more hinges 162*c*, 262*c*. In other embodiments, the sliding wall 162, 262 may include a single panel or more than two panels. In still further embodiments, the first and second vertical panels 162*a*, 262*a*, 162*b*, 262*b* are connected through other suitable means.

In the first embodiment illustrated in FIGS. 1, 8A, and 8B, each sliding wall assembly 160 includes the slidable wall 162 and upper and lower track members 164, 166 on which the wall 162 moves, as shown in FIG. 8A. Each track system 164, 166 includes a panel track member 164*a*, 166*a* and a wall track member 164*b*, 166*b* that cooperate to enable the sliding motion.

Specifically, the upper track system 164 includes an upper panel track member 164*a* that is secured to an inner surface of the side panel 122 along which the slidable wall 162 moves. An upper wall track member 164*b* is mounted to an upper surface of the first vertical panel 162*a* of the slidable wall 162 and engages with the upper panel track member 164*a*.

Similarly, the lower track system 166 includes a lower panel track member 166*a* that is secured to the inner surface of the same side panel 122. A lower wall track member 166*b* is mounted to a lower surface of the first vertical panel 162*a* of the slidable wall 162 and engages with the lower panel track member 166.

In some embodiments, each panel track member 164*a*, 166*a* provides a groove along a length thereof, and the respective wall track member 164*b*, 166*b* includes a wheel that moves laterally along the groove of the respective panel track member 164*a*, 166*a*.

Each of the first and second vertical panels 162*a*, 162*b* include roller assemblies 168 on bottom surfaces thereof to enable the panels 162*a*, 162*b* to move laterally along the ground. In the embodiment illustrated in FIG. 8A, the lower wall track member 166*b* on the bottom surface of the first vertical panel 162*a* has a length that is less than a length of the bottom surface of the first panel 162*a* in order to provide sufficient space for a first panel roller assembly 168 adjacent to the hinged connection 162*c* to the second vertical panel 162*b*. A second panel roller assembly 168 is provided on a bottom surface of the second vertical panel 162*b*.

In some embodiments, the roller assemblies 168 include a roller wheel mounted to a rotating planar member in order to enable rolling in multiple directions. Specifically, the rotating planar member is secured to the respective vertical panel at a first pivot point, and the roller wheel is mounted to the rotating planar member at a second pivot point offset from the first pivot point, which enables the roller wheel to rotate around the second pivot point as needed. In other embodiments, the roller assemblies 168 include conventional roller wheel hardware.

The rolling hardware of the roller assemblies 168 may include a spring-loaded rubber stop that moves between a locked position and an unlocked position. In some embodiments, the rolling hardware allows for vertical level adjustment. For example, if an existing floor is out of level in the direction of the depth of the unit, the telescoping beam (i.e., the track 130 and the secondary support member 132) and rolling hardware 150 can accommodate approximately a ½" to ¾" levelness variance.

In the retracted position illustrated in FIG. 1, the vertical panels 162*a*, 162*b* are folded together about the one or more hinges 162*c*, and the sliding wall 162 is withdrawn into the storage system 100 so that upper surfaces of the vertical panels 162*a*, 162*b* are positioned below the storage unit 100. In this illustrated embodiment, no part of the sliding wall 162 extends outwardly of the storage system 100. During use, sliding doors 182 may be slid in front of the retracted walls 162 in a direction perpendicular to the lateral motion of the slidable wall 162 without obstruction.

In the extended position illustrated in FIGS. 8A and 8B, the second vertical panel 162*b* has been rotated about the hinged connection 162*c* so that the first vertical panel 162*a* and the second vertical panel 162*b* folded away from one another in order to be aligned and coplanar. The vertical panels 162*a*, 162*b* are then pulled out of the respective storage compartment 126 along the upper and lower track systems 164, 166 so that they extend outwardly from the storage system 100.

In the second embodiment illustrated in FIGS. 9-13, each sliding wall assembly 260 similarly includes a slidable wall 262 that moves between a retracted position and an extended position, differing from the first embodiment storage system 100 in the components of the track mechanism. The sliding wall assembly 260 comprises a primary support beam 264 including a track 266, a secondary support beam 268 including a roller mechanism 270 that engages the track 266, and the sliding wall 262 that is secured to the secondary support member 268.

Similar to the slidable wall 162 of the first embodiment, the sliding wall 262 includes a first vertical panel 262*a* and a second vertical panel 262*b* that are hingedly connected by one or more hinges 262*c* and include roller assemblies 268 on the bottom surfaces thereof to enable the sliding movement between a retracted position and an extended position.

Referring to FIGS. 11 and 12, the track 266 is provided on an underside of the primary support beam 264 extending between a single scaffold 222 and a double scaffold 224 of the storage system. The sliding wall 262 moves along the track 266 in and out of the space between the parallel trusses 224*a*, 224*b* of the double scaffold 224 as shown in FIG. 12.

The connections between the track 266 and the underside surface of the primary support beam 264 can be by welds, fasteners, and/or the like. The track 266 can be channel-shaped and suitable to receive the roller assembly 270. For example, the track 266 can be C-shaped and comprise at least one underside shouldered edge 266*a* configured to retain and support the roller assembly 270 of the secondary support beam 268. In one embodiment, the track is C-shaped and includes a pair of underside shouldered edges 266*a*, 266*b*, each configured to retain a wheel of a roller assembly 270 including parallel wheels 270*a*. In the illustrated embodiment, the track 266 is C-shaped and includes a pair of underside shouldered edges 266*a*, 266*b*, each configured to retain a pair of wheels 270*a*, 270*b* of a roller assembly 270 including parallel pairs of wheels, as shown in FIGS. 11 and 12.

The position of the track 266 is fixed with respect to the storage system 100 and the secondary support member 268 moves relative thereto. The secondary support member 268 moves between a retracted position, where the secondary support member 268 is positioned within the respective storage compartment 226 and between the parallel trusses of the double scaffold 224, and an extended position, where the secondary support member 268 is extended beyond the front side 200*b* of the storage system 200 and away from the respective double scaffold 224. For example, together the track 266 and the secondary support member 268 can form a telescoping beam.

The wall 262 is fixedly attached to the secondary member 268. For example, the sliding wall 262 can be secured to an underside of the secondary support member 268 through a fixed lock nut and threaded shank 272 attached to a top surface of the sliding wall 262, as shown in FIGS. 11 and 12.

The sliding door 262 may not require an anchored floor track, which can enable the storage system 200 to be installed in existing buildings with asbestos flooring, without abatement. A base door guide can be anchored to the framing system 220 if desired without disturbing the existing floor.

In the retracted position, the vertical panels 262*a*, 262*b* are folded together about the one or more hinges 262*c*, and the sliding wall 262 is withdrawn into the storage system 200 so that upper surfaces of the vertical panels 262*a*, 262*b* are positioned below the storage unit 240. The vertical panels 262*a*, 262*b* are retracted between parallel trusses of the double scaffold 224. In this embodiment, no part of the sliding wall 262 extends outwardly of the storage system 202. During use, sliding doors 282 may be slid in front of the retracted walls 262 in a direction perpendicular to the lateral motion of the slidable wall 262 without obstruction as desired.

In the extended position, the second vertical panel 262*b* has been rotated about the hinged connection 262*c* so that the first vertical panel 262*a* and the second vertical panel 262*b* are folded away from one another in order to be aligned and coplanar. The vertical panels 262*a*, 262*b* are then pulled out of the respective storage compartment 226 so that the secondary support member 268 moves laterally along the primary support member 264, which remains fixed in place, such that the first and second vertical panels 262*a*, 262*b* extend outwardly from the storage system 200.

In some examples, the sliding door assembly 260 includes magnets positioned at the top and/or bottom of a side surface of the sliding wall to secure the sliding wall 262 in a compact storage position.

In both storage systems 100, 200, the sliding wall 162, 262 can include various components such as, for example, one or more of a white board, a slatted surface, and one or more shelving units. A slatted surface may provide flexible storage, allowing for individual customization of the unit by using hanging shelving units, hooks, pockets, or other components on the slotted structures as desired. As an example, the user could have shelving, cabinetry, and specialized slat wall accessories to allow for the proper mix of storage devices for the user's specific needs.

The storage system 100, 200 can be used for high density classroom library book storage, which allows for out-facing display storage of elementary age literacy materials using slat wall units (e.g., clear acrylic slat wall units). The sliding walls can also be arranged to create an alcove for individual space, a calming zone for students with disabilities, or an activity zone for a specific activity for a portion of the students Sliding Door Assembly The storage system 100, 200 also includes a sliding door assembly 180, 280 providing a sliding door 182, 282 for closure of each storage compartment. The sliding door assembly 180, 280 includes a sliding door track member 184, 284 that extends along the front side 100*b*, 200*b* of the storage system 100, 200 and one or more doors 182, 282 mounted to the door track member.

Figure 2:
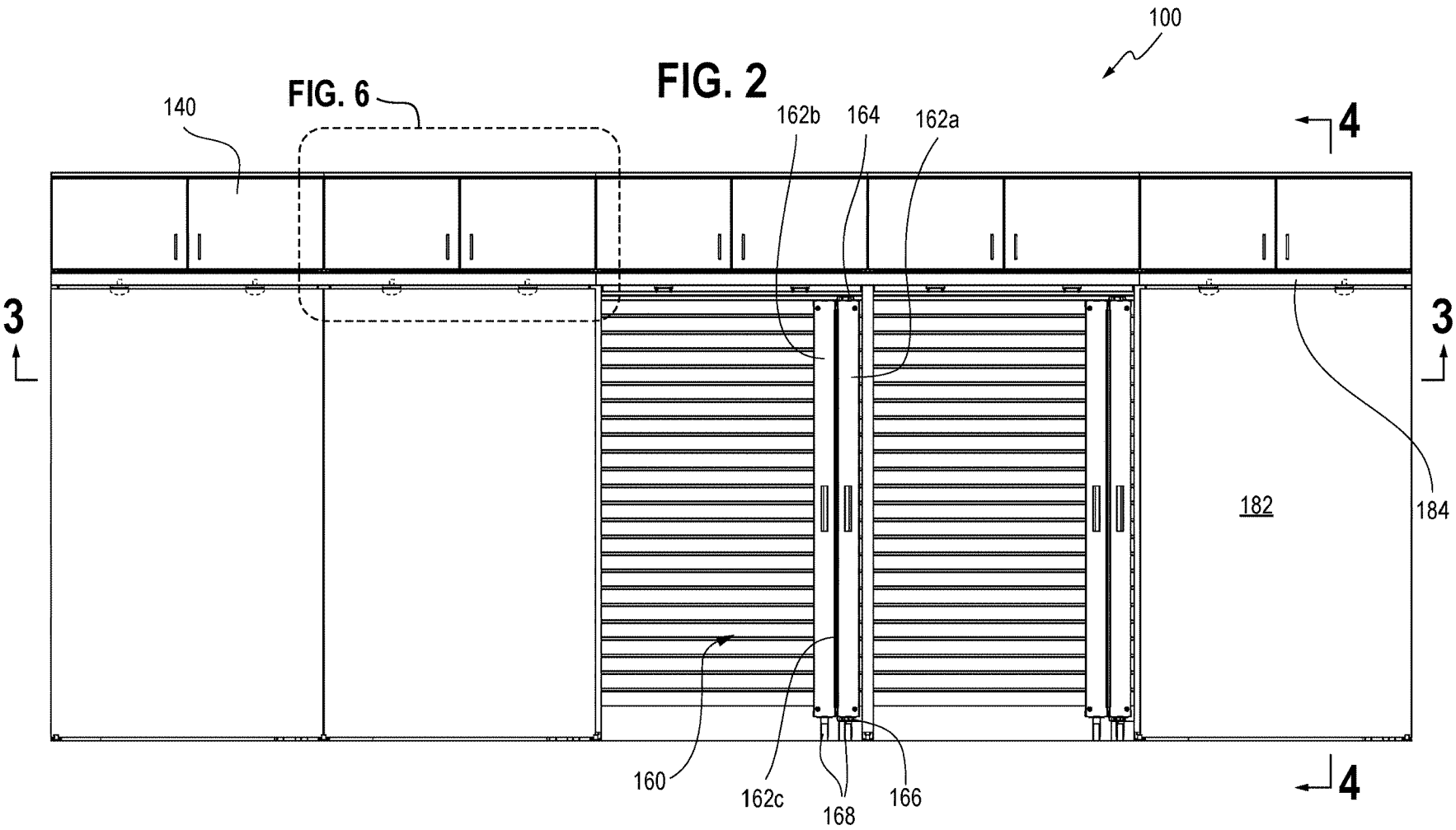
FIG. 2 is a front elevational view of the storage system of FIG. 1.
Figure 3:
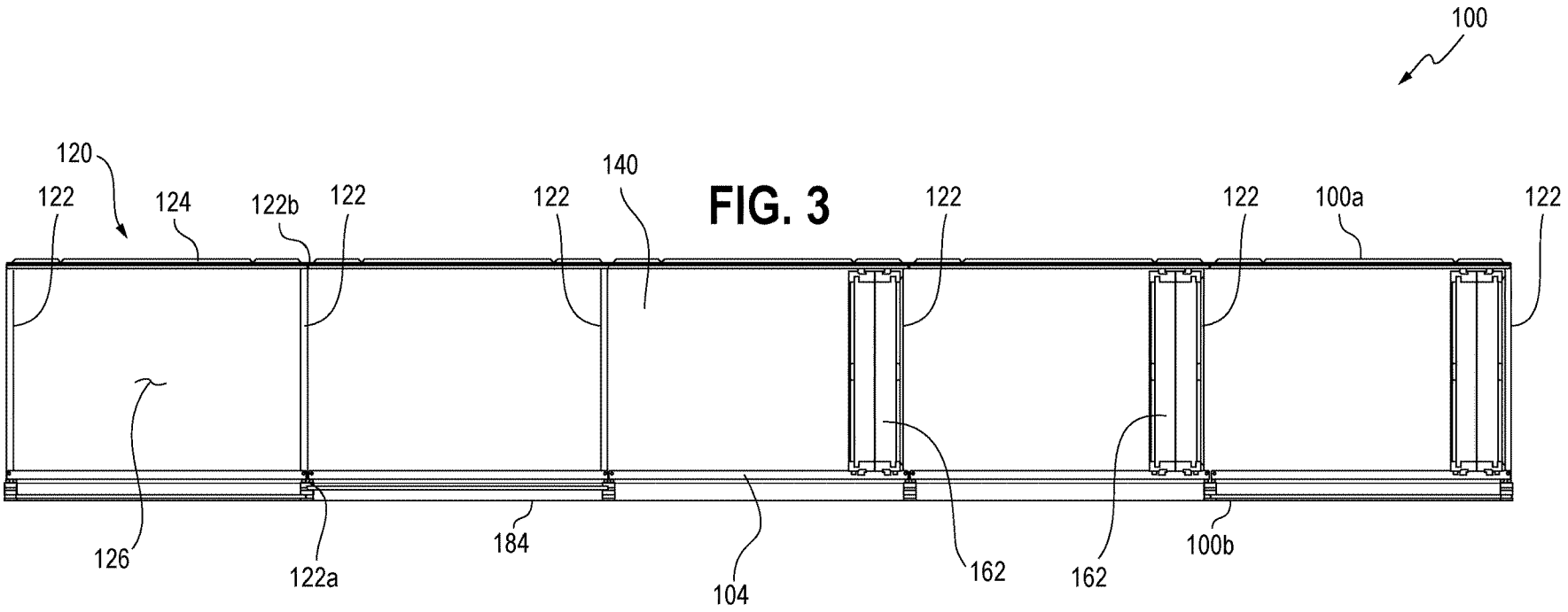
FIG. 3 is a cross-sectional view of the storage system of FIG. 1 generally taken along lines 3-3 in FIG. 2.

In the first embodiment shown in FIGS. 1-3, the door track member 184 is secured to the undersides of one or more base surfaces 144 of the plurality of storage units 140 along a front edge 100*b* of the storage system 100. As shown in FIG. 5, the door track member 184 is a bracket having a C-shape with parallel shouldered edges 184*a*, 182*b* on an underside thereof. The parallel shouldered edges includes a front track 184*a* and a rear track 182*b* parallel to the front edge of the storage system.

Each door 182 includes a roller assembly 186 on an upper surface thereof for engaging with and sliding along the door track member 184. Each roller assembly includes a roller 186*a* that engages the front track 184*a* or the rear track 184*b* of the door track member 184. In one embodiment, the one or more doors 182 include first, second, and third doors 182*a*, 182*b*, 182*c*. The first and second doors 182*a*, 182*b* are mounted to the front track 184*a* of the door track member 184, and the third door 182*c* is mounted to the rear track 184*b* of the door track member 184. In another embodiment, the sliding door assembly 180 includes first through five doors 182*a*-182*e*, with the first, second, and third doors 182*a*-182*c* mounted to the front track 184*a* and the fourth and fifth doors 182*d*, 182*e* mounted to the rear track 184*b*.

In the second embodiment, the sliding door assembly 280 includes a sliding track 284 for each sliding door 282. The sliding tracks 284 are provided on an underside of the base surface 240*a* of at least one storage unit 240, as illustrated in FIG. 13. The sliding door 282 slidably engages the respective sliding track 284.

Because the system 100, 200 provides an elevated storage system, the system 100, 200 optimizes vertical space and does not monopolize floor space. As a result, the system 100, 200 provides increased storage without reducing the floor space for students. Therefore, students can move about the room for lessons and activities without being encumbered with the storage units. The storage systems 100, 200 of the present application can optimize usable floor area by eliminating the need for other storage units such as book shelves and bins.

In addition, the present system 100, 200 is customizable. For example, the system is modular wherein storage units 140, 240 can be grouped together in an arrangement that is suitable for each classroom, and, moreover, for each activity. For example, the system 100, 200 can be easily transformed into various arrangements throughout the day to accommodate various activities. Further, the storage units 140, 240 can be customized to store a variety of items, unlike conventional drawers or cabinets.

The system 100, 200 can provide more flexibility to incorporate additional mobile, furniture-based storage components within the unit. Additional conventional storage units, such as drawer systems, open shelving, stacked bins or baskets, etc., can be stored within each storage compartment 126, 226 behind the sliding doors 182, 282 to clear floor area for student classroom activity. The items can be retrieved for classroom use when needed.

The present system 100, 200 can be installed without the need to attach to existing building structural components, although certain components such as, but not limited to, the rear panels 124 of the storage system 100 or the rear surface 240*c* of the storage units 240 of the storage system 200 can be secured to a wall for additional safety. Moreover, the present system 100, 200 does not require the installation of floor or ceiling tracks for moving the sliding units as many convention solutions require. As a result, the present system 100, 200 can be used on uneven flooring. Further, the installation of the present system 100, 200 does not require removal or disturbing any asbestos flooring, thereby reducing costs.

In an example, the present system 100, 200 can include a compact storage of classroom literacy materials for easy access and display for students. The system 100, 200 can increase the average cubic feet of storage in a traditional classroom by utilizing vertical storage volume.

The system 100, 200 can include lighting. For example, a bottom surface of the storage units and/or the frame infrastructure can include a plurality of lights. In an example, colored LED lights can be used for therapeutic lighting for students with special needs. For example, the system 100, 200 can include at least one bracket that enables LED and/or LCD displays, smart boards, among other displays to be mounted to the framing system and stored behind the storage unit walls.

The system 100, 200 can include receptacles for charging electronic devices such as laptops, mobile phones, tablets, among others. The storage units 140, 240 can include storage accessories for particular storage needs for a business or classroom materials. The system 100, 200 can be suitable for any ceiling height, including, but not limited to ceilings in the range of 7-10 feet.

The storage system 100, 200 is transformable to create spaces for small group work, isolating certain groups of students, and/or provide space for specialized lessons. For example, the system can be arranged to provide privacy for students during testing or independent work. The system 100, 200 can provide a "calming zone" for de-escalation of inclusion students with special needs without removal from the classroom. While shown as creating space between immediately adjacent doors, a wider personal space may be created, for example, by using non-adjacent doors.

Although the systems 100, 200 of the present disclosure are described with reference to a classroom environment, the system 100, 200 can be used for any type of space such as play spaces, basements, business offices, medical offices, dorms, homes, and kitchens, among many others.

Various embodiments are described and illustrated herein to provide an overall understanding of the structure, function, and use of the disclosed articles and methods. The various embodiments described and illustrated herein are non-limiting and non-exhaustive. Thus, an invention is not limited by the description of the various non-limiting and non-exhaustive embodiments disclosed herein. Rather, the invention is defined solely by the claims. The features and characteristics illustrated and/or described in connection with various embodiments may be combined with the features and characteristics of other embodiments. Such modifications and variations are intended to be included within the scope of this specification. As such, the claims may be amended to recite any features or characteristics expressly or inherently described in, or otherwise expressly or inherently supported by, this specification. Further, the applicant reserves the right to amend the claims to affirmatively disclaim features or characteristics that may be present in the prior art. The various embodiments disclosed and described in this specification can comprise, consist of, or consist essentially of the features and characteristics as variously described herein.

Any references herein to "various embodiments", "some embodiments", "one embodiment", "an embodiment", "a non-limiting embodiment", or like phrases mean that a particular feature, structure, or characteristic described in connection with the example is included in at least one embodiment. Thus, appearances of the phrases "in various embodiments", "in some embodiments", "in one embodiment", "in an embodiment", "in a non-limiting embodiment", or like phrases in the specification do not necessarily refer to the same embodiment. Furthermore, the particular described features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation. Such modifications and variations are intended to be included within the scope of the present embodiments.

In this specification, unless otherwise indicated, all numerical parameters are to be understood as being prefaced and modified in all instances by the term "about," in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described herein should at least be construed in light of the number of reported significant digits and by applying ordinary rounding techniques.

Any numerical range recited herein includes all sub-ranges subsumed within the recited range. For example, a range of "1 to 10" includes all sub-ranges between (and including) the recited minimum value of 1 and the recited maximum value of 10, that is, having a minimum value equal to or greater than 1 and a maximum value equal to or less than 10. Also, all ranges recited herein are inclusive of the end points of the recited ranges. For example, a range of "1 to 10" includes the end points 1 and 10. Any maximum numerical limitation recited in this specification is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited. All such ranges are inherently described in this specification.

The grammatical articles "a", "an", and "the", as used herein, are intended to include "at least one" or "one or more", unless otherwise indicated, even if "at least one" or "one or more" is expressly used in certain instances. Thus, the foregoing grammatical articles are used herein to refer to one or more than one (i.e., to "at least one") of the particular identified elements. Further, the use of a singular noun includes the plural and the use of a plural noun includes the singular, unless the context of the usage requires otherwise.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

What is claimed is:

1. A storage system comprising:

a framing assembly comprising:

a plurality of side panels and a plurality of rear panels, each side panel including a front vertical edge and a rear vertical edge, wherein a rear panel associated with each pair of side panels spans the rear vertical edges thereof, and wherein each side panel spans a full height and a full width between the front vertical edge and the rear vertical edge;

a plurality of storage units, each storage unit comprising a top surface and a base surface, each of the top surface and the base surface secured to and spanning a pair of side panels and the associated rear panel; and a sliding wall assembly comprising:

a sliding wall comprising a horizontal length, an upper surface, a lower surface, a first vertical panel, and a second vertical panel, wherein the sliding wall moves laterally parallel to the plurality of side panels between a wall retracted position and a wall extended position, the first vertical panel is rotatably connected to the second vertical panel such that the second vertical panel is configured to be placed in a closed position in which a face of the first vertical panel and a face of the second vertical panel are positioned immediately adjacent to and facing each other and an open position in which the face of the second vertical panel is rotated away from the face of the first vertical panel such that the face of the first vertical panel and the face of the second vertical panel face a common direction, wherein when the first vertical panel and the second vertical panel are in the open position, the second vertical panel is positioned further away from at least one of the rear panels than the first vertical panel measured along a line that extends normal to the at least one of the rear panels, wherein the first vertical panel comprises a first rolling hardware on a bottom surface of the first vertical panel and the second vertical panel comprises a second rolling hardware on a bottom surface of the second vertical panel, and wherein each of the first rolling hardware and the second rolling hardware is configured to enable movement between the wall retracted position and the wall extended position on a ground surface;

an upper track system including an upper panel track member and an upper wall track member, wherein the upper panel track member is secured to the framing assembly and the upper wall track member is secured to the upper surface of the sliding wall; and a lower track system including a lower panel track member and a lower wall track member, wherein the lower panel track member is secured to the framing assembly and the lower wall track member is secured to the lower surface of the sliding wall;

wherein each of the upper and lower wall track members engage the upper and lower panel track members, respectively.

2. The storage system of claim 1, wherein the plurality of side panels and the plurality of rear panels are interconnected through brackets.

3. The storage system of claim 1, wherein each of the rolling hardware includes a spring-loaded rubber stop that moves between a locked position and an unlocked position.

4. The storage system of claim 1, wherein the first vertical panel and the second vertical panel are connected by a one or more hinges, the first vertical panel is parallel to the plurality of side panels.

5. The storage system of claim 4, wherein the first vertical panel and the second vertical panel fold towards and away from each other about the one or more hinges to move between the open and closed positions.

6. The storage system of claim 1, wherein each sliding wall includes one or more of a white board, a slatted surface, and one or more shelving units.

7. The storage system of claim 1, comprising a sliding door assembly comprising a door track member secured to a front of the framing assembly, and one or more doors, each door including a door roller assembly on an upper door edge, wherein the roller assembly comprises a roller that engages the door track member.

8. The storage system of claim 7, wherein the door track member includes a front track and a rear track, wherein the one or more doors of the sliding door assembly includes a first door and a second door, wherein the door roller assembly of the first doors is mounted to the front track of the door track member, and wherein the door roller assembly of the second door is mounted to the rear track of the door track member.

9. The storage system of claim 1, wherein the second vertical panel is connected to the first vertical panel by a one or more hinges and the second vertical panel is moveable 180 degrees relative to the first vertical panel to be positioned in any of a plurality of relative panel positions.

10. The storage system of claim 9, wherein, in one of the plurality of relative panel positions, the second vertical panel is co-planar with the first vertical panel.

11. The storage system of claim 9, wherein the plurality of relative panel positions includes a first panel position and a second panel position, the sliding wall is movable laterally parallel to the plurality of side panels between the first panel position and the second panel position, the second vertical panel overlaps the first vertical panel in the first panel position, the second vertical panel extends the horizontal length of the sliding wall away from at least one of the rear panels when in the second panel position.

12. The storage system of claim 11, wherein a first lateral edge of the sliding wall opposite the at least one of the rear panels is offset from a first lateral edge of the plurality of side panels opposite the at least one of the rear panels when in the wall retracted position.

13. A storage system comprising:

a framing assembly comprising:

a plurality of side panels and a plurality of rear panels, each side panel including a front vertical edge and a rear vertical edge, wherein a rear panel associated with each pair of side panels spans the rear vertical edges thereof;

a plurality of storage units, each storage unit comprising:

a top surface and a base surface, each of the top surface and the base surface spanning a pair of side panels of the plurality of side panels and the associated rear panel;

a plurality of top surface shelf supports, each top surface shelf support connected to the framing assembly and supporting the top surface of the storage unit;

a plurality of base surface shelf supports, each base surface shelf support connected to the framing assembly and supporting the base surface of the storage unit;

a sliding door assembly comprising:

a door track member secured to one or more base surfaces of the plurality of storage units along a front edge, wherein the track member includes a track;

one or more doors, each door including a door roller assembly on an upper door edge, wherein the roller assembly includes a roller that engages the track of the door track member; and a sliding wall assembly comprising:

a sliding wall comprising a horizontal length, an upper surface, a lower surface, a first vertical panel, and a second vertical panel, the first vertical panel is parallel to the plurality of side panels, the first vertical panel is connected to the second vertical panel, the sliding wall is movable between a wall extended position and a wall retracted position, the second vertical panel moves relative to the first vertical panel between a plurality of relative panel positions and, in at least one of the relative panel positions, and the second vertical panel is positioned further away from at least one of the rear panels than the first vertical panel measured along a line that extends normal to the at least one of the rear panels;

an upper track system including an upper panel track member and an upper wall track member, wherein the upper panel track member is secured to the framing assembly and the upper wall track member is secured to the upper surface of the sliding wall; and a lower track system including a lower panel track member and a lower wall track member, wherein the lower panel track member is secured to the framing assembly and the lower wall track member is secured to the lower surface of the sliding wall;

wherein each of the upper and lower wall track members engage the upper and lower panel track members, respectively.

14. A storage system comprising:

an upper portion comprising a plurality of upper compartments; and a lower portion connected to the upper portion and comprising a rear wall, a plurality of side walls, a plurality of lower compartments, and a sliding wall assembly, the rear wall and the plurality of side walls defining at least a portion of the plurality of lower compartments;

the sliding wall assembly comprising a sliding wall, an upper track system, and a lower track system, the sliding wall comprising a horizontal length, an upper end, and a lower end, a first vertical panel, and a second vertical panel, wherein the sliding wall is movable laterally parallel to the plurality of side walls between a wall retracted position and a wall extended position, the sliding wall is laterally offset from the plurality of side walls when in the wall extended position, the first vertical panel is rotatably connected to the second vertical panel such that the second vertical panel is configured to be placed in a closed position in which a face of the first vertical panel and a face of the second vertical panel are positioned immediately adjacent to and facing each other and an open position in which the face of the second vertical panel is rotated away from the face of the first vertical panel such that the face of the first vertical panel and the face of the second vertical panel face a common direction, wherein, when the first vertical panel and the second vertical panel are in the open position, the second vertical panel is positioned further away from the rear wall than the first vertical panel measured along a line that extends normal to the rear wall, wherein the first vertical panel comprises a first rolling hardware on a bottom surface of the first vertical panel and the second vertical panel comprises a second rolling hardware on a bottom surface of the second vertical panel, and wherein each of the first rolling hardware and the second rolling hardware is configured to enable movement between the wall retracted position and the wall extended position on a ground surface;

wherein the upper end is connected to the upper track system; and, wherein the lower end is connected to the lower track system.

15. The storage system of claim 14, wherein a first lateral edge of the sliding wall opposite the rear wall is offset from a first lateral edge of the plurality of side walls opposite the rear wall when in the wall retracted position.

16. The storage system of claim 14, wherein the second vertical panel is connected to the first vertical panel by a one or more hinges and the second vertical panel is rotatable 180 degrees relative to the first vertical panel between the open position and the closed position about the one or more hinges.

17. A storage system comprising:

an upper portion comprising a plurality of upper compartments;

a lower portion connected to the upper portion and comprising a rear wall, a plurality of side walls, a plurality of lower compartments, and a sliding wall assembly, the rear wall and the plurality of side walls defining at least a portion of the plurality of lower compartments;

the sliding wall assembly comprising a sliding wall, an upper track system, and a lower track system, the sliding wall comprising a horizontal length, an upper end, and a lower end, a first vertical panel, and a second vertical panel, wherein the sliding wall is movable laterally parallel to the plurality of side walls between a wall retracted position and a wall extended position, the sliding wall is laterally offset from the plurality of side walls when in the wall extended position, the first vertical panel is connected to the second vertical panel, the second vertical panel is movable between a panel retracted position and a panel extended position, the second vertical panel extends the horizontal length of the sliding wall away from the rear wall when in the panel extended position, wherein the upper end is connected to the upper track system, wherein the lower end is connected to the lower track system; and a sliding door assembly comprising a track and a sliding door engaging the track and arranged to enclose a front of at least a portion of the plurality of lower compartments, wherein the sliding door is movable transverse to a sliding path of the sliding wall between the wall retracted position and the wall extended position, the sliding wall is behind the sliding door when in the wall retracted position and extends in front of the sliding door when in the wall extended position.

* * * * *